United States Patent [10]

Weppler

[11] 4,045,824

[45] Sept. 6, 1977

[54] GLOVE FOR RING DISPLAY

[76] Inventor: Millie T. Weppler, 6324 77th St., Middle Village, N.Y. 11379

[21] Appl. No.: 695,166

[22] Filed: June 11, 1976

[51] Int. Cl.[2] ..... A41D 19/00

[52] U.S. Cl. ..... 2/163

[58] Field of Search ..... 2/159, 163, 158, 160, 2/161 R, 161 A

[56] References Cited

U.S. PATENT DOCUMENTS

| | | | |
|---|---|---|---|
| 1,620,434 | 3/1927 | Burden | 2/163 |
| 2,724,119 | 11/1955 | Ohman | 2/159 |

*Primary Examiner*—G. V. Larkin

*Attorney, Agent, or Firm*—Robert D. Farkas

[57] ABSTRACT

A glove that is especially constructed for displaying the ring worn on the ring finger by providing for a portion of the ring finger stall tube removable from the remainder of the glove and when attached thereto provides for an open area displaying the ring.

5 Claims, 3 Drawing Figures

GLOVE FOR RING DISPLAY

BACKGROUND OF THE INVENTION

This invention relates to a glove; more particularly, to a glove adapted to display a ring worn on the hand.

The prior art teaches a variety of gloves of this nature, such as disclosed in U.S. Pat. Nos. 1,358,823–4; 2,443,938 2,513,030; 2,655,662; 2,724,119; 2,883,668; 3,703,007; and others.

SUMMARY OF THE INVENTION

It is accordingly an object of the instant invention to provide for a new and improved finger ring displaying glove.

It is another object to provide for a glove that has the attributes as aforedescribed.

It is a further object to provide the same at relatively little cost thereby making it generally available.

These and other objects and advantages of the invention will become more apparent from the following detailed disclosure and claims and by reference to the accompanying drawings, in which:

Figure 1:
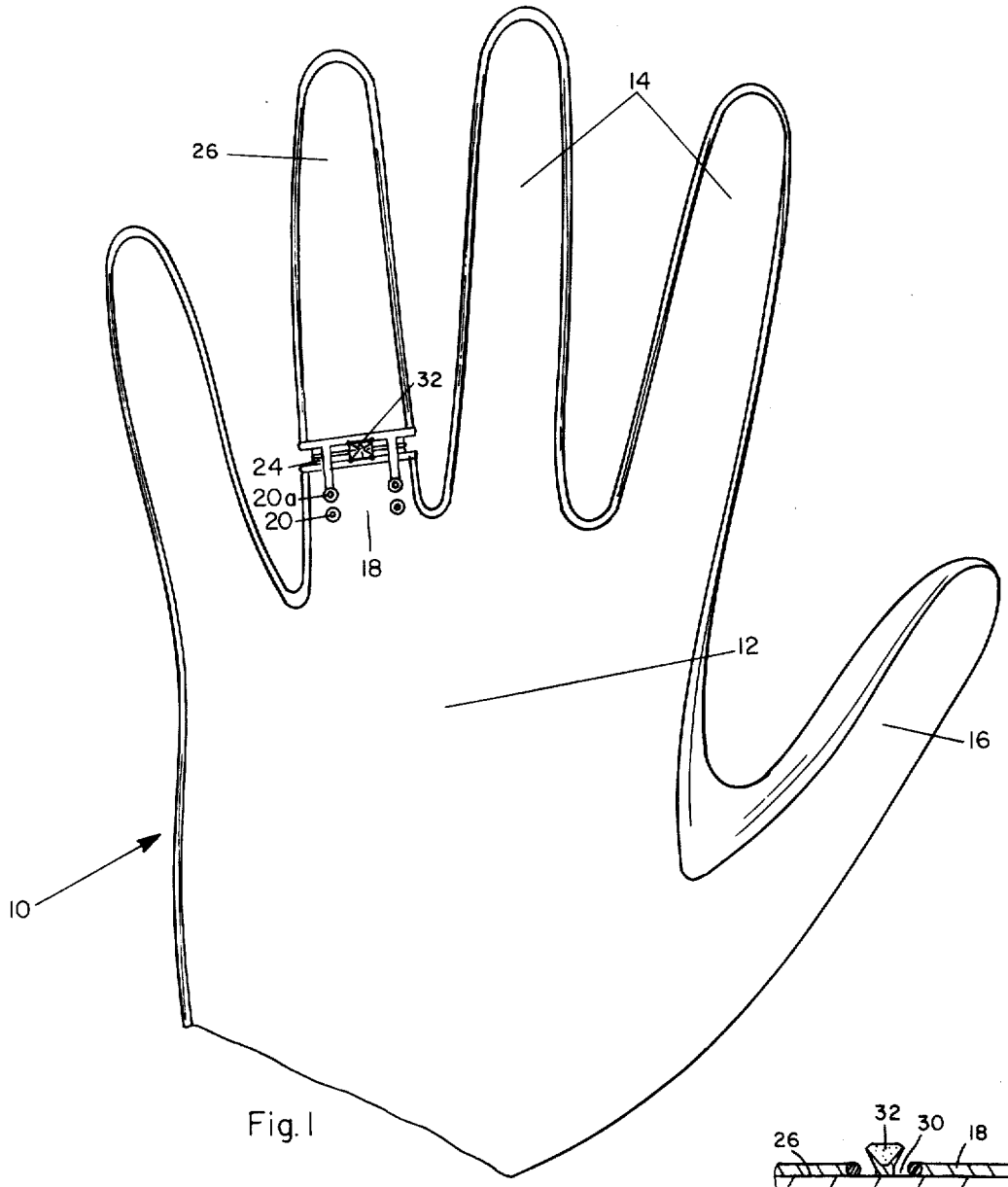
FIG. 1 is a top plan view.
Figure 3:
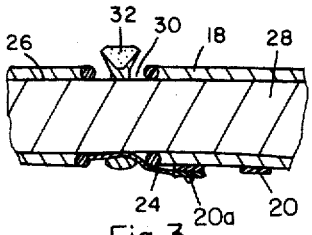
FIGS. 2–3 are side views.
Figure 2:
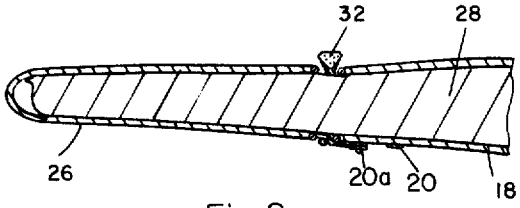

Broadly speaking, the instant invention includes the provision of a glove comprising a palm portion, a back portion, a plurality of finger stalls and a thumb stall, at least one of the finger stalls being open at the distal end thereof, the open finger stall being of a length short of contacting the knuckles of the finger, a pair of longitudianlly spaced apart first and second closure means disposed on the outer surface of the open finger stall, a hollow finger capping member having one closed end and one open end, the member being adapted to receive the finger exposed by the open finger stall, at least one tab member on the capping member, cooperating third closure means on the tab member adapted to engage the first or second means, the capping member contacting and covering the two knuckles on the exposed finger, whereby when the first means is engaged an annular slot is defined between the capping member and the open stall thereby exposing a portion of the finger thereon and thus a ring worn thereon.

DETAILED DISCLOSURE

Referring more particularly to the drawings, there is shown a glove 10 that includes a back portion 12 and a plurality of (four) finger receiving stalls 14 and a thumb stall 16. One finger stall 18 of the glove 10 is open and shorter in size and provides for protrusion of the finger therefrom. This short stall 18 has a plurality of closure means 20, such as one half of snap sets disposed thereon. This form of snap set is adapted to join with a complementary snap fastener disposed on a flexible tab member 24. There are at least two closure means 20, 20*a,* in spaced apart relation disposed along the length of finger stall 18, aligned and one being forward of the other on the stall 18. In the preferred embodiment there are a pair of each one half snap sets, each member of the pair of one half snaps sets being in spaced apart relation. There is a pair of one half snap sets being in spaced apart relationship and aligned in a similar fashion to the first pair of one half snap sets. The second pair of one half snap sets is disposed intermediate the first pair of one half snap sets and the juncture of finger stall 18 and the back portion 12.

A cap member of finger cot 26 which is a sleeve closed at the distal end and open at the opposite distal end fits over the exposed portion of the finger 28. The tab members 24 are integrally connected to the open distal end thereof such that when the sleeve 26 is placed over the finger 28, the tab member carrying one complementary snap set member thereon is adapted to cooperate with the other means 20*a* comprising one half snap sets thereby engaging the short stall 18. If the tab member 24 engages the forward means 20*a* comprising one half snap sets, an annular slot 30 defined between the member 24 and the stall 18 thereby providing for display of the ring 32. On the other hand, where the ring 32 is not to be displayed or is not worn, the tab member 24 engages the rearward one half snap sets or means 20 thereby eliminating the space or slot 30.

It should be noted that the interior length of the sleeve 26 is such that when the tab member 24 engages the rearward means 20 the finger snugly fits thereinto, while when the means 20a are engaged, the distal end of the stall 18 is empty, the tip of the finger being removed therefrom.

In the preferred embodiment, the short stall 18 is of a length such that its open end engages the finger behind the first knuckle joint, while the sleeve 26 is of a length that it covers both knuckles on the finger.

Since it is obvious that numerous changes and modifications can be made in the above-described details without departing from the spirit and nature of the invention. It is to be understood that all such changes and modifications are included within the scope of the invention.

I claim:

1. A glove comprising a palm portion, a back portion, a plurality of finger stalls and a thumb stall, at least one of said finger stalls being open at the distal end thereof, said open finger stall being of a length short of contacting the knuckles of the finger, a pair of longitudinally spaced apart first and second closure means disposed on the outer surface of said open finger stall, a hollow finger capping member having one closed end and one open end, said member being adapted to receive the finger exposed by said open finger stall, at least one tab member on said capping member, cooperating third closure means on said tab member adapted to engage said first or second means, said capping member contacting and covering the two knuckles on said exposed finger, whereby when said first means is engaged an annular slot is defined between said capping member and said open stall thereby exposing a portion of the finger thereon and thus a ring worn thereon.

2. A glove as defined in claim 1 wherein there are a pair of parallel tab members.

3. A glove as defined in claim 1 wherein said tab member is flexible.

4. A glove as defined in claim 2 wherein there are a pair of first and second closure means in parallel and spaced apart relation.

5. A glove as defined in claim 1 wherein said closure means are snaps.

* * * * *